US005685480A

United States Patent [19]

Choi

[11] Patent Number: 5,685,480

[45] Date of Patent: Nov. 11, 1997

[54] INSULATED DRINKING CUP

[76] Inventor: Danny K. Choi, 2192 Sweet Briar, Tustin, Calif. 92680

[21] Appl. No.: 698,664

[22] Filed: Aug. 16, 1996

[51] Int. Cl.[6] ..... B65D 3/22

[52] U.S. Cl. ..... 229/403; 220/441; 229/939

[58] Field of Search ..... 229/400, 403, 229/939, 4.5; 220/737–739, 441, 443

[56] References Cited

U.S. PATENT DOCUMENTS

| | | | |
|---|---|---|---|
| 2,266,828 | 12/1941 | Sykes | 220/441 |
| 2,661,889 | 12/1953 | Phinney | 220/441 |
| 4,993,580 | 2/1991 | Smith | 220/443 |
| 5,205,473 | 4/1993 | Coffin, Jr. | 220/441 |
| 5,542,599 | 8/1996 | Sobol | 229/4.5 |
| 5,547,124 | 8/1996 | Mueller | 229/4.5 |

*Primary Examiner*—Gary E. Elkins
*Attorney, Agent, or Firm*—Erik M. Arnhem

[57] ABSTRACT

A disposable insulated drinking cup includes an inner liner, an outer annular shell, and an air-filled spacer between the liner and shell. The spacer includes a corrugated wall adhered to a backing sheet. Both the corrugated wall and backing sheet are of thin-wall construction to maximize the air volume and insulation properties of the spacer.

7 Claims, 1 Drawing Sheet

INSULATED DRINKING CUP

BACKGROUND AND SUMMARY OF THE INVENTION

This invention relates to a disposable drinking cup, and particularly to a disposable insulated drinking cup. An aim of the invention is to provide a cup having an insulated side wall, whereby coffee or other hot liquid in the cup will remain in a heated condition for a reasonably long period of time without burning the hand of the person holding the cup.

The prior art shows various cup constructions having insulated side walls.

U.S. Pat. No. 2,266,828, issued to W. Sykes, discloses a paper cup having a corrugated liner secured to the cup proximate to the cup upper edge and lower edge. The corrugations run circumferentially, to provide an insulative air space between the cup side wall and liner.

U.S. Pat. No. 3,456,860, granted to W. Janninck, shows a double-walled insulative cup that comprises inner and outer cup-shaped elements telescoped one within the other. The cup-shaped elements have circumferentially spaced helical ribs angled in different directions so that ribs on the inner element angularly intersect ribs on the outer element, to provide mutual support points and insulative spaces therebetween.

Shikaya, U.S. Pat. No. 3,908,523 shows an insulated cup that comprises a paper cup having a corrugated sleeve telescoped onto the cup outer surface, to form insulative air spaces within the corrugation flutes.

U.S. Pat. No. 5,092,485, to T. Lee, shows an insulated paper cup that comprises an inner paper cup member, a corrugated paper sleeve telescoped onto said inner member, and an outer smooth-surfaced sleeve or cup member telescoped onto the corrugated sleeve. The corrugations form insulative air spaces.

Titus, U.S. Pat. No. 5,460,323 shows a paper cup having an annular liner anchored to the cup side wall proximate to the upper and lower edges of the cup. The liner has a bowed cross-section designed to provide an annular air space in the mid plane of the cup where a person would normally grasp the cup outer side surface.

The present invention relates to a disposable drinking cup that includes a frusto-conical liner, a frusto-conical outer shell, and an annular spacer means between the liner and shell. The spacer means comprises a corrugated wall and a smooth-surfaced backing sheet secured to the outer face of the corrugated wall. Lower end areas of the liner and outer shell are received in an annular channel provided in the peripheral edge of a bottom disk.

The liner and outer shell are each formed of a relatively thick sheet material; the liner may be paper or plastic, whereas the outer shell is preferably paper. The walls of the spacer means are formed of relatively thin sheets of paper, such that the volume of the spacer means is primarily air; consequently the spacer means has relatively good thermal insulating properties. Typically the corrugated wall and backing sheet of the spacer means have wall thickness of only about 0.003 inch (substantially less than the wall thickness of the liner and outer shell).

A principle aim of the invention is to provide a disposable drinking cup that uses a comparatively small quantity of material in its construction, while having relatively good thermal insulation properties.

A further aim of the invention is to provide a disposable drinking cup that includes an outer shell having a relatively smooth outer surface suitable for printing colors or messages, whereby the cup has high sales appeal for advertising or ornamental reasons.

Further features and advantages of the invention will be apparent from the attached drawings and description of an illustrative embodiment of the invention.

THE DRAWINGS

DESCRIPTION OF A PREFERRED EMBODIMENT OF THE INVENTION

Figure 1:
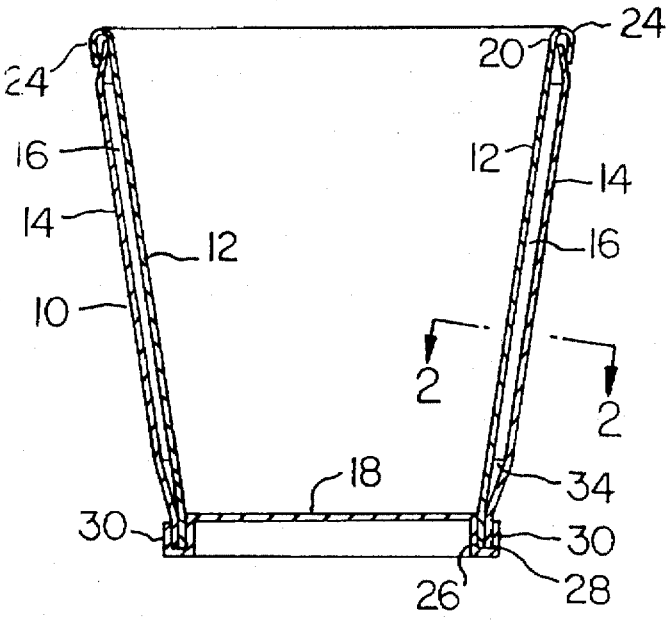
FIG. 1 is a sectional view taken through a disposable drinking cup embodying the invention.
Figure 3:
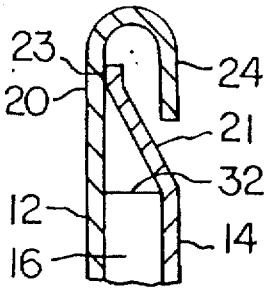
FIG. 3 is an enlarged fragmentary view of a structural detail at the upper end of the cup depicted in FIG. 1.

FIG. 1 shows a stackable disposable drinking cup constructed according to the invention. The cup comprises an annular side wall 10 that includes a frusto-conical liner 12, a frusto-conical outer shell 14, and an annular spacer means 16 between the liner and shell. The cup further comprises a bottom disk 18 spanning the lower ends of liner 12 and shell 14.

Frusto-conical liner 12 has an upper end 20 adhesively secured to upper end 21 of shell 14, as at 23. The upper end 20 of liner 12 terminates in a curled edge 24 that extends over the upper end of shell 14 to provide a smooth-surfaced lip, free of sharp edges.

Frusto-conical liner 12 has a lower end 26 sealably and adhesively secured to a bottom disk 18. The end of liner 12 extends within a channel 30 formed in the peripheral edge of bottom disk 18. Liner 12 can be formed of paper or sheet plastic having a wall thickness that is preferably about 0.02 inch. The thickness of bottom disk 18 can be about 0.03 inch in a typical cup construction.

Outer shell 14 is a smooth-surfaced frusto-conical structure telescoped onto liner 12 so as to engage end areas of the liner. An annular spacer means 16 is interposed between the liner and shell, to provide thermal insulation between the liner and shell, whereby the cup can be used for containing hot beverages without fear of scalding or burning the hand of the person holding the cup.

Annular spacer means 16 extends entirely around liner 12 in the areas where a person would be likely to grasp the cup. The spacer means has an upper edge 32 spaced below the upper end of shell 14 and a lower edge 34 proximate to the lower end of shell 14.

Figure 2:
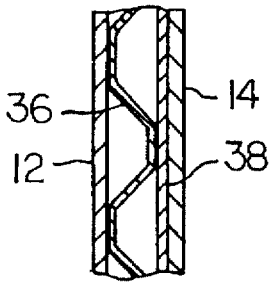
FIG. 2 is an enlarged fragmentary transverse sectional view taken on line 2—2 in FIG. 1.

Spacer means 16 is not visible in FIG. 1, due to the drawing scale. As shown in FIG. 2, the spacer means comprises a corrugate wall 36 facing liner 12 and a smooth-surfaced backing sheet 38 facing the outer shell 14. The corrugations in wall 36 extend generally vertically from the upper edge 32 of the spacer means to the lower edge 34. The crest areas of the corrugations can be adhesively attached to liner 12; trough areas of the corrugations can be adhesively attached to backing sheet 38 prior to incorporating the spacer means 16 into the cup.

Figure 5:
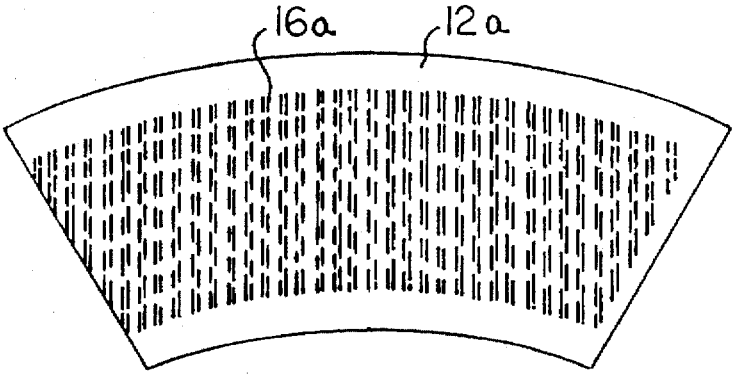
FIG. 5 is a plan view of a blank that can be used in the formation of the FIG. 1 cup.
Figure 4:
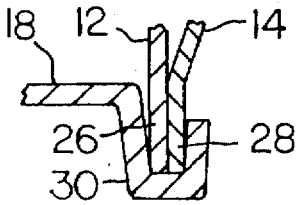
FIG. 4 is an enlarged fragmentary view of a structural detail used at the lower end of the cup.
Figure 6:
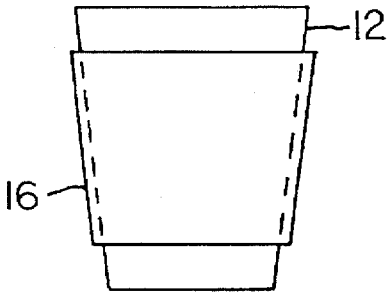
FIG. 6 is a view of the FIG. 5 after it has been wound into a frusto-conical shape.

FIG. 5 shows a blank that can be used in manufacturing the FIG. 1 cup. As shown in FIG. 5, the blank comprises a flat sheet of paper or plastic 12A and a corrugated flat sheet means 16A secured to the face of sheet 12A. The multi-piece blank 12A, 16A can be wound into a frusto-conical configuration as shown in FIG. 6. The FIG. 6 three-dimensional member forms the starting point for the FIG. 1 cup.

Frusto-conical shell 14 can be wound into a tubular configuration prior to incorporation into the cup. The tubular frusto-conical shell 14 can be slipped axially onto the FIG. 6 frusto-conical construction, to form-the cup body (except for bottom disk 18). After liner 12, spacer means 16, and shell 14 have been adhesively secured together the bottom disk 18 can be secured to the cup side wall, using a suitable adhesive in the annular channel 30. As the last step in the cup manufacture, the upper edge of liner 12 can be curled to form the lip 24. Some variation in the sequence of manufacturing steps can be practiced while still achieving the final cup construction.

In preferred practice of the invention, the liner 12 and shell 14 each have a wall thickness of about 0.02 inch. The radial thickness of spacer means 16 is about 0.08 inch. Corrugated wall 36 has a preferred thickness of about 0.003 inch or 0.004 inch. Similarly, backing sheet 38 has a preferred thickness of about 0.003 inch or 0.004 inch. While 36 and 38 are relatively thin compared to the radial thickness of the spacer means formed by walls 36 and 38, such that the spacer means is constituted primarily of air. The spacer means thus has a relatively good insulative value for a given cup wall thickness.

Liner 12 and shell 14 are of sufficient thickness as to have some structural stability. Additional structural stiffening is provided by the corrugated spacer means 16. Even though walls 36 and 38 are relatively thin, the corrugated nature of the sheet assembly 36,38 gives the spacer means a desired resistance against crushing or collapse under normal usage.

Shell 14 is preferably formed of a smooth-surfaced paper sheet suitable for receiving printing inks or colorings. The cup structure uses a relatively small quantity of materials while achieving good structural integrity and good thermal insulative properties.

What is claimed is:

1. A stackable disposable drinking cup comprising:

a frusto-conical liner having an upper end and a lower end;

a frusto-conical outer shell telescoped onto said liner; said outer shell having an upper end and a lower end;

an annular spacer means located between said liner and said outer shell; and a bottom disk spanning the lower ends of said liner;

said bottom disk having an annular channel receiving the lower end of said liner to form a sealed connection between said disk and said liner;

the upper end of said liner being curled radially outwardly around the upper end of said shell.

2. The drinking cup of claim 1, wherein said annular spacer means has an upper annular edge spaced below the upper end of said shell, and a lower annular edge spaced above the lower end of said liner.

3. The drinking cup of claim 2, wherein said annular spacer means comprises a corrugated wall and a smooth-surfaced backing sheet secured to said corrugated wall.

4. The drinking cup of claim 3, wherein said corrugated wall has crest surfaces thereof adhered to said liner, and said backing sheet has one major surface thereof adhered to said outer shell.

5. The drinking cup of claim 4, wherein the wall thickness of said corrugated wall and backing sheet is substantially less than the wall thickness of said liner or said outer shell.

6. The drinking cup of claim 5, wherein said backing sheet and said corrugated wall each have a thickness of about 0.003 inch, and said liner and said outer shell each have a thickness of about 0.02 inch.

7. The drinking cup of claim 1, wherein said liner and said shell each have a wall thickness of about 0.02 inch, and said spacer means has a radial thickness of about 0.08 inch.

* * * * *